United States Patent [19]

Gannon

[11] Patent Number: 4,744,199

[45] Date of Patent: May 17, 1988

[54] VACUUM PACKAGING

[75] Inventor: Raymond Gannon, London, United Kingdom

[73] Assignee: FGL Projects Limited, London, United Kingdom

[21] Appl. No.: 828,059

[22] Filed: Feb. 10, 1986

[30] Foreign Application Priority Data

Feb. 12, 1985 [GB] United Kingdom ..... 8503545
May 28, 1985 [GB] United Kingdom ..... 8513385

[51] Int. Cl.[4] ..... B65B 31/02; B65B 31/06
[52] U.S. Cl. ..... 53/434; 53/512
[58] Field of Search ..... 53/434, 512, 103, 105, 53/404, 433, 432

[56] References Cited

U.S. PATENT DOCUMENTS

| | | | |
|---|---|---|---|
| 32,018 | 11/1885 | Domke et al. | 53/404 X |
| 1,594,512 | 8/1926 | Von der Lippe-Lipski | 53/103 X |
| 2,870,954 | 1/1959 | Kulesza | 53/432 X |
| 3,714,754 | 2/1973 | Holcombe et al. | 53/434 |
| 3,851,437 | 12/1974 | Waldrop et al. | 53/434 |
| 4,221,101 | 9/1980 | Woods | 53/512 X |
| 4,478,025 | 10/1984 | Scanlan | 53/434 X |
| 4,534,152 | 8/1985 | Akkala | 53/434 |
| 4,548,852 | 10/1985 | Mitchell | 53/432 X |
| 4,581,764 | 4/1986 | Plock et al. | 53/434 X |

FOREIGN PATENT DOCUMENTS

| | | | |
|---|---|---|---|
| 2247452 | 4/1974 | Fed. Rep. of Germany | 53/512 |
| 2409716 | 11/1975 | Fed. Rep. of Germany | 53/512 |
| 2446771 | 8/1980 | France | 53/433 |

*Primary Examiner*—Horace M. Culver
*Attorney, Agent, or Firm*—Henry Sternberg; Bert J. Lewen

[57] ABSTRACT

A process of packaging goods particularly foodstuffs in which the goods are placed in a first container for example a plastics bag or a tray having a deformable lid, sealing the container except for an aperture provided by an open valve. The container is then placed in a second container having rigid walls. A vacuum is then created in both containers after which the inner container is completely sealed by for example closing the valve whilst preventing the entry of undesireable substances. In a preferred process an inert or preserving gas is introduced into the first container prior to sealing.

9 Claims, 1 Drawing Sheet

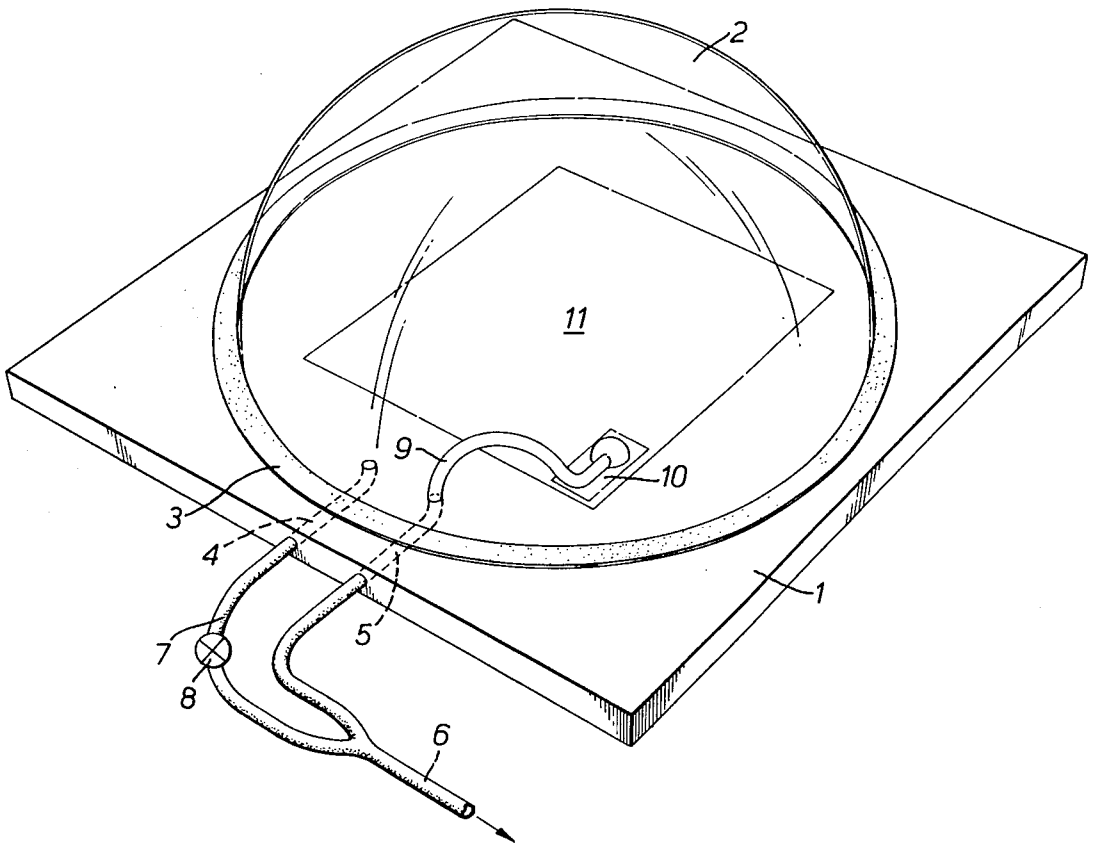
1
2
3
4
5
6
7
8
9
10
11

VACUUM PACKAGING

This invention relates to an improved process for vacuum packaging of goods and more particularly for the packaging of small quantities of foodstuffs and of small and delicate products.

In principle vacuum packaging is an uncomplicated process in which the goods are placed in a container having at least one deformable wall such as a bag made of a film of plastics material. The container is then connected to a source of vacuum for example a vacuum pump and air is then withdrawn from the container. During the development of the vacuum within the bag the deformable wall collapses around the goods. The opening in the bag is then sealed whilst the contents are maintained under vacuum. In practice conventional methods of carrying out the process have a number of defects. For example in general they utilise equipment which is too expensive and cumbersome for small scale use such as packaging of medical samples and portions of meat or other foodstuffs to be supplied at the retail level. Consequently vacuum packaging has hitherto been confined largely to factory operations. The objections to conventional methods however do not stem solely from their scale of operation. They have in addition other defects. For example during the generation of the vacuum within the package the manner in which the plastics film is forced by atmospheric pressure onto the goods results in small pockets or cavities being formed between the wall and the goods which conventional vacuum pumps are unable to evacuate satisfactorily. As a result a satisfactory vacuum is not obtained and this in turn impairs the shelflife of goods which are perishable. Another disadvantage is that atmospheric pressure forces the film wall onto the goods in an uncontrolled manner which can result in crushing of the goods if they are of a delicate and compressible nature. The present invention is directed to overcoming one or more of the above disadvantages.

Accordingly this invention provides a process for the vacuum packaging of goods comprising placing the goods in an unsealed or partly sealed first container having at least one deformable wall placing the container in a second container having a substantially non-deformable wall or walls creating a vacuum in both containers sealing the first container whilst preventing the entry of undesirable substances.

This invention is illustrated by but not restricted by the following drawings which shows in perspective one form of apparatus for carrying out invention process.

Referring first to the FIGURE there is shown an apparatus for vacuum packaging an item (not shown), such as a food item. The apparatus comprises a planar base plate (1) on which there is disposed a hemispherical dome (2). Around the periphery of the dome there is a sealing element (3) made for example from natural or synthetic rubber. Two passageways (4 and 5) lead through the base plate to spaced-apart locations within the dome. The passageways (4 and 5) are connected by a Y-shaped tube (6) to a source (not shown) of vacuum, such as a vacuum pump. A leg (7) of the tube (6) connected to the passageway (4) has an isolating valve (8) therein. The end of the passageway (5) within the dome is connected by a tube (9) to a valve (10) forming part of the container which, in this instance, is a pouch or bag (11) containing the item to be vacuum packaged.

The operation of the apparatus will now be described. The item to be packaged is placed in bag (11) which is sealed by conventional means such as heat sealing or by adhesive. At this stage valve (10) is in the open condition. The bag is then placed on the base plate (1) and valve (10) is connected to tube (9). The dome is then placed over the bag with seal (3) in good sealing contact with base plate (1). Tube (6) is connected to the source of vacuum and valve (8) is opened to extract air from the interior of the dome through passageway (4) and from the interior of the bag through passageway (5). When the desired degree of vacuum, indicated by a gauge (not shown), is reached valve (8) is operated to connect the interior of the dome to atmosphere and thereby to break the vacuum within the dome. The vacuum pump, however, continues to remove air from the bag. Once the interior of the dome is at atmospheric pressure, the dome can be removed from the base plate. Valve (10) is then closed to maintain the desired degree of vacuum in the bag. Tube (6) is then disconnected or isolated from the source of vacuum and tube (9) disconnected from the valve (10).

In the process employing the apparatus depicted in the figure and interiors of each of the containers is connected separately to a vacuum pump without there being any direct communication between the two interiors. In this way greater control can be exercised in reducing the pressure in each of them. For example if the interior of the outer container is evacuated more rapidly than the interior of the inner container there will be a tendency for the walls of the inner container to balloon away from the goods present in the container. As a consequence there will be a reduced tendency for voids to be formed between the walls and the goods.

The above process lends itself to a number of valuable applications. For example if the goods to be packaged are of a delicate nature which would be damaged by rapid compressive action of the walls of inner container the following procedure can be adopted. The goods are placed in the inner container in the usual way. The container is then placed in the outer container and air is pumped out until the desired degree of vacuum has been created in both containers. At this stage air is admitted gradually into the outer chamber and either dry sterile air or other preserving or inert gas is admitted into the inner container. When the pressure in both containers has reached atmospheric the inner container is then sealed by closing the valve.

Processes of the present invention are of especial value in prolonging the freshness of a wide range of foodstuffs by so-called modified atmosphere packaging techniques referred to in this specification as MAP. In these processes the food is packaged in a container such as a bag or covered tray made of thermoplastics materials which are highly resistant to gas diffusing through the walls of the containers. A modified atmosphere is used in the containers that is to say an atmosphere which contains those gases namely carbon dioxide, nitrogen and oxygen which are components of the ordinary atmosphere but in different proportions. Thus the shelf lives of various foodstuffs whilst chilled can be doubled and in some cases trebled by using MAP gases of the appropriate composition of the different foods for example;

| Food | % by vol. Carbon dioxide | % by vol. Nitrogen | % by vol. Oxygen |
|---|---|---|---|
| Fish | 40 | 30 | 30 |
| | 60 | — | 40 |
| Red Meat | 60 | 19 | 21 |
| Poultry | 25 | 65 | 10 |
| Cured meat | 20 | 80 | — |
| Dairy products | 100 | — | — |
| Cheese | 75 | 25 | — |
| | 100 | — | — |

Other gases can be used for example nitrous oxide and carbon monoxide where local laws permit.

In order to use an MAP gas in accordance with the present invention the equipment shown in the FIGURE can be modified readily so that when the air has been pumped out of both the bag and the dome, air is then admitted into the dome whilst an MAP gas is introduced into the bag.

A further variant which can be used in the packaging of foodstuffs is to admit a dispersion of a flavouring material into the inner container prior to sealing.

The form of equipment to be used in operating the present process can be varied extensively according to nature of the products to be packaged and the method employed in creating the vacuum in the inner and outer containers. One form of preferred inner container has a closure or valve comprising a deformable chamber connectable to a source of vacuum, an aperture in the container providing fluid connectable communication between the interior of the container and the interior of the chamber, adhesive means within the chamber arranged so that on deformation of the chamber, a portion thereof adheres around the aperture to obstruct the fluid communication.

In general such valves are connected to or form part of the container and comprise a small spherical or hemispherical chamber having an inlet communicating with the atmosphere and an outlet communicating with the interior of the container where the foodstuff is located. At least one wall of the chamber is deformable and when the chamber is squeezed the deformable wall is pressed into such close intimate contact with the opposing wall that communication between the inlet and the outlet is prevented. The intimacy of this contact can be maintained in different ways for example by the resilient properties of the material of which the valve is comprised. Alternatively the inner surface of one of the opposing walls of the chamber can be coated with a pressure sensitive adhesive so that when the walls are pressed together they continue to adhere to one another thus preventing the passage of air or other gas through the valve. Another method of maintaining the two walls in contact is to use a thermoplastics material in the construction of the valve and to apply heat and pressure to the chamber to heat seal the opposing walls together.

The outer container is preferably in combination a dome or hemi-cylindrical container made of stainless steel or a transparent plastics material for example a poyester, a polyacrylate or a polycarbonate and a base plate. Containers of this kind are very strong and can withstand sufficiently high vacua for present purposes without imploding. Furthermore they are relatively cheap to manufacture and light and easy to operate. It will be appreciated nevertheless that containers of other shapes and of different designs can also be used.

The present processes are used with various types of inner containers although bags having flexible walls and trays which have semi rigid walls and a lid made made from thin filmic material are preferred. Since many plastics materials are permeable to air or other gases bags are made preferably of a laminate consisting for example of a substrate such as cellulose, nylon, polypropylene or polyester. This is covered with a second layer having much greater gas impermeability for example polyvinylidene dichloride or aluminium foil. This combination is then coated with polyethylene or an adhesive to enable the laminate to be heat sealed. A wall of the bag can also form part of a valve.

Preferred trays are made from any thermoplastics material used in the food packaging industry and having a lid consisting for example of a thin deformable sheet of polyvinylidene dichloride. In the preferred trays a part of one wall of the tray provides one wall of a valve, whilst the other wall of the valve is formed by a part of the lid.

Any conventional method can be used for generating vacua in the containers. Vacuum pumps which have been found eminently suitable for operating the present process are available under the trade mark VAC-SAC. These pumps have different ratings depending upon the speed with which the vacua are required to be formed and the levels of vacuum requires. In general pressures of about 100 millibars confers a shelf life of about three months onto perishable goods and this is sufficient for most purposes. However the invention process permits longer shelf lives to be achieved if more intense vacua are employed.

The present processes can be used for the packaging of a wide variety of products apart from foodstuffs including medical samples, electrical and electronic components.

What is claimed is:

1. A process for packaging goods which comprises: placing the goods in an unsealed first container having at least one deformable wall, a semi-rigid opposing wall, and a valve integrally formed at least in part from said deformable wall and the opposing wall, said deformable wall being resilient, having a first stable position wherein the valve is opened and a second stable position wherein the deformable wall is in intimate contact with the opposing wall and the valve is closed; placing the container in a second container having substantially non-deformable walls; forming a vacuum separately in both said first and second containers while the valve is opened; and squeezing the deformable wall from its first stable position to the second stable position to close the valve and to interrupt the flow of fluids from the interior to the exterior of said first chamber, said valve remaining in its closed position by means of the resiliency of the deformable wall.

2. The process of claim 1 wherein an inert or preserving gas is introduced into said first container prior to closing said valve.

3. The process of claim 1 wherein the gas is an MAP gas.

4. The process of claim 1 wherein the first container is a thermoplastic material.

5. The process of claim 1 wherein said valve is closed after the pressure in said containers is restored to atmospheric.

6. The process of claim 1 wherein the valve contains adhesive means so that the squeezing of the deformable wall serves to permanently close the valve.

7. The process of claim 1 wherein the deformable wall of the valve comprises a small, spherical or hemispherical chamber.

8. The process of claim 1 wherein the deformable valve wall, when squeezed, snaps intimately against the opposing wall so as to close the valve.

9. The process of claim 8 wherein one of the valve walls is coated with pressure-sensitive adhesive so that, when the opposing walls are squeezed together, the aperture is sealed.

* * * * *